US008115584B2

(12) United States Patent
Eriksson et al.

(10) Patent No.: US 8,115,584 B2
(45) Date of Patent: Feb. 14, 2012

(54) INDUCTION DEVICE

(75) Inventors: Anders Bo Eriksson, Ludvika (SE); Julia Forslin, Ludvika (SE)

(73) Assignee: ABB Technology Ltd. (CH)

( * ) Notice: Subject to any disclaimer, the term of this patent is extended or adjusted under 35 U.S.C. 154(b) by 0 days.

(21) Appl. No.: 13/114,853

(22) Filed: May 24, 2011

(65) Prior Publication Data

US 2011/0227683 A1 Sep. 22, 2011

Related U.S. Application Data

(63) Continuation of application No. PCT/EP2008/066051, filed on Nov. 24, 2008.

(51) Int. Cl.
*H01F 17/06* (2006.01)

(52) U.S. Cl. ..... 336/178

(58) Field of Classification Search ..... 336/55–62, 336/178

See application file for complete search history.

(56) References Cited

U.S. PATENT DOCUMENTS 3,274,526 A * 9/1966 Emanuelson ..... 336/60
3,593,243 A 7/1971 Trump et al.
3,691,492 A * 9/1972 Muller ..... 336/60
7,782,168 B2 * 8/2010 Nakatsu et al. ..... 336/221
2007/0080769 A1 * 4/2007 Thiel et al. ..... 336/65

FOREIGN PATENT DOCUMENTS

CH 459351 A 7/1968
DE 3414113 A1 10/1985
GB 1229437 4/1971

OTHER PUBLICATIONS

International Search Report and Written Opinion of the International Searching Authority; PCT/EP2008/066051; Jul. 28, 2009; 13 pages.

* cited by examiner

*Primary Examiner* — Tuyen Nguyen
(74) *Attorney, Agent, or Firm* — St. Onge Steward Johnston & Reens LLC

(57) ABSTRACT

An induction device for association with high voltage electric transmission systems having at least one core frame and at least one winding arranged around said core frame. The induction device has at least one magnetic core leg arranged in said core frame. The core frame includes a stack of core segments of a magnetic material being cooled by cooling medium, arranged in compression in the core frame, core gaps being arranged to separate the core segments, and a plurality of spacers, arranged in the core gaps between the core segments, with a cross section of hexagonal shape, having an upper and a lower end-face being in contact with the core segments. The spacers in at least one of the core gaps are arranged densely packed so as to form a compact filling in the core gap.

4 Claims, 4 Drawing Sheets

INDUCTION DEVICE

CROSS-REFERENCE TO RELATED APPLICATIONS

The present application is a continuation of pending International patent application PCT/EP2008/066051 filed on Nov. 24, 2008 which designates the United States and the content of which is incorporated herein by reference.

FIELD OF THE INVENTION

The present invention relates to an induction device, such as a shunt reactor to provide power of the order of several tens of MVA, to be used in association with high voltage electric transmission systems above 1 kV. The invention is particularly applicable to a shunt reactor for use in a power system, for example in order to compensate the capacitive reactance of long electricity power transport lines, which are generally high-voltage power lines or extended cable systems.

BACKGROUND OF THE INVENTION

The function of a shunt reactor is generally to provide a required inductive compensation necessary for power line voltage control and stability in high voltage transmission lines or cable systems. The prime requisites of a shunt reactor are to sustain and manage high voltage and to provide a constant inductance over a range of operating inductions. Simultaneously, shunt reactors are to have a low profile in size and weight, low losses, low vibration and noise, and sound structural strength.

A shunt reactor generally comprises a magnetic core composed of one or more core legs, also denoted core limbs, connected by yokes which together form one or more core frames, for each phase. Further, a shunt reactor is made in such a manner that a coil encircles said core leg. It is also well known that shunt reactors are constructed in a manner similar to the core type power transformers in that both use high permeability, low loss grain oriented electrical steel in the yoke sections of the cores. However, they differ markedly in that shunt reactors are designed to provide constant inductance over a range of operating inductions. In conventional high voltage shunt reactors, this is accomplished by use of a number of large air gaps in the core leg, also denoted core limb, section of the reactor core. Said core legs are being fabricated from packets, also denoted core segments, of magnetic material such as electrical steel strips. The core legs are constructed by alternating the core segments with ceramic spacers to provide a required air gap. Said core segments are separated from each other by at least one of said core gaps and said spacers are being bonded onto said core segments with epoxy to form cylindrical core elements. Further, said spacers are typically made of a ceramic material such as steatite. Said core segments are made of high-quality radial laminated steel sheets, layered and bonded to form massive core elements. Further, said core segments are stacked and epoxy bonded to form a core leg with a high modulus of elasticity.

Said core is accommodated in a tank comprising a tank base plate and tank walls together with a foundation supporting the tank. It is also well known that induction devices, such as shunt reactors, are immersed in cooling medium such as oil.

Today, the ceramic spacers are cylinder shaped and typically fill the core gaps to approximately 50-60%. A way to increase the filled area, in said core gaps, is to use hexagonal shaped spacers, and by doing so said spacers can be packed closely together leaving no space between each other.

A problem with this solution is that the cooling of the core segments will be reduced due to major loss of oil flow at the top and bottom core segment surfaces.

Known methods for cooling induction devices, such as transformers or reactors, are Oil Natural Cooling or Oil Force Cooling.

It is a well-known problem that the core gaps are a source of vibrations and noise in an electrical power reactor. Such noise emitted from the reactor must be limited in order not to disturb surrounding areas, and the cost of eliminating said noise becomes prohibitive. Cooling medium, such as oil, will transfer said vibrations from the core gap to the reactor tank, thus causing said noise to be emitted from said induction device. Vibrations are generated since magnetic forces are created when a magnetic flow passes through the core segments and the spacers. Energization of the electrical windings surrounding a magnetic core results in alternating magnetization of the core, and the core segments cyclically expand and contract due to the phenomena of magnetostriction when magnetized and demagnetized by the current flowing in the transformer windings. The phenomenon of magnetostriction means that if a piece of magnetic steel sheet is magnetized, it will extend itself. When said magnetization is interrupted, said sheet will return to its original size. The magnetic core thus acts as a source of 100 Hz or twice the operating frequency of the reactor vibrations and harmonics thereof. The vibrations generated by the magnetic core together with the weight of the core and core assembly may force the rigid base structure beneath a reactor casing into vibration. The casing sidewalls are rigidly connected to the base structure and may be driven into vibration by the stiff base members and propagate noise.

In oil-immersed induction devices to which the present invention relates, the magnetic core is placed in a tank, and the vibrations are propagating by the tank base and the oil to the tank walls are causing noise.

SUMMARY OF THE INVENTION

The present invention seeks to provide a way to reduce the noise emitted by the induction device with a satisfactory cooling of the core segments surfaces.

An object of the invention is achieved by providing an induction device. The device is characterised in that the spacers in at least one of the core gaps are arranged densely packed so as to form a compact filling in the gap, and that for at least some of the spacers the edges of the end faces of two neighboring spacers are arranged with chamfers allowing said neighboring spacers to form a common cooling duct for the cooling medium. The advantage with the arrangement is that, by arranging the spacers densely packed, an increased stiffness of the core leg will be achieved. An increased stiffness of the core leg will reduce the vibrations in the core leg and thus the emitted noise from the reactor will be reduced. At the same time the arrangement with the cooling ducts will achieve that the cooling of said core segments will be kept within a satisfactory level. The spacers are arranged with an upper end face, a lower end face and six side faces. By saying that the spacers are arranged densely packed, it is understood that the spacers are arranged so that the side faces of two neighboring spacers are arranged preferably in contact with, or at a very close distance from, each other.

According to one embodiment, the width of the chamfers is at least 20% of the radius of the spacer. Thereby a satisfactory cooling effect is achieved.

According to one further embodiment, the height of the cooling duct is at least 20% of the height of the spacer. Thereby a satisfactory cooling effect is achieved.

According to one further embodiment, the induction device is a shunt reactor.

Further features and advantages of the present invention will be presented in the following detailed description of a preferred embodiment of the induction device according to the invention.

BRIEF DESCRIPTION OF THE DRAWINGS

Other features and advantages of the present invention will become more apparent to a person skilled in the art from the following detailed description in conjunction with the appended drawing in which.

DETAILED DESCRIPTION OF THE INVENTION

Figure 1:
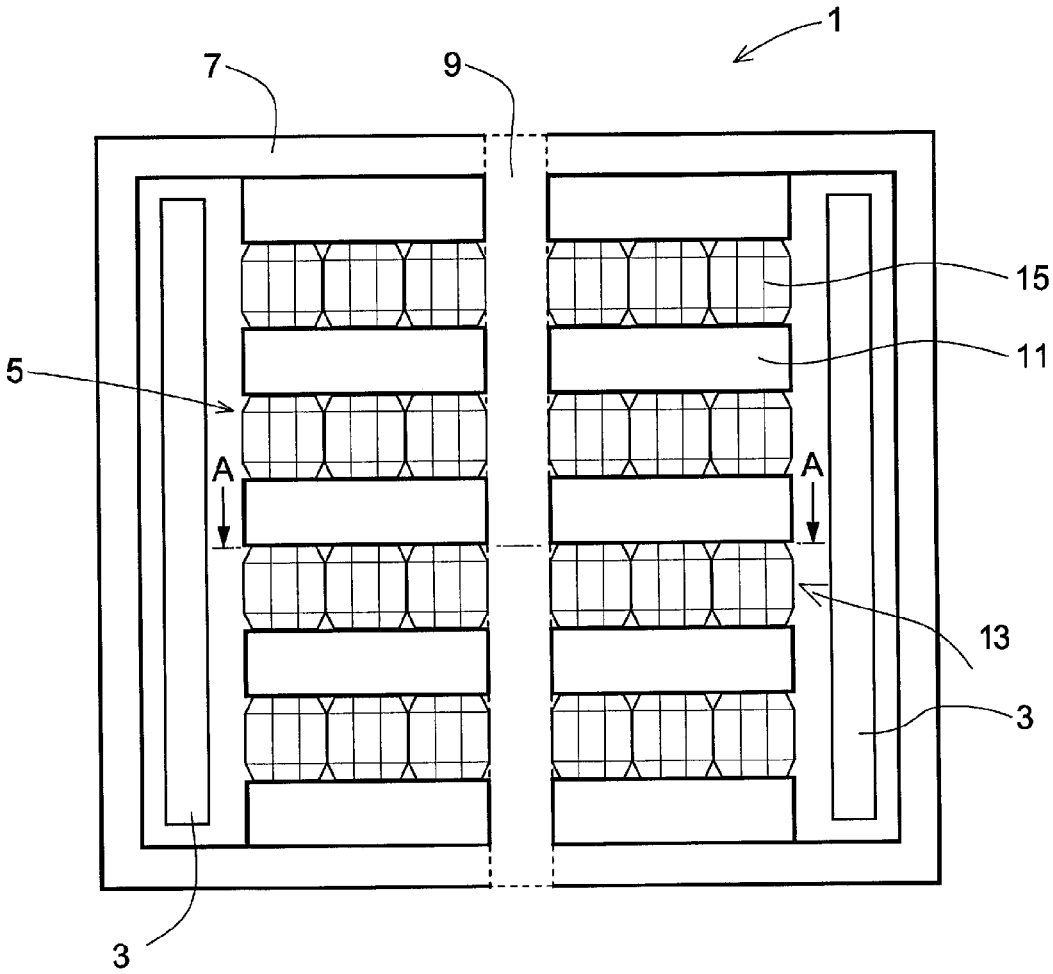
FIG. 1 is a longitudinal cross-sectional view through an induction device according to an embodiment of the invention.

FIG. 1 illustrates an induction device 1 according to an embodiment of the invention. The induction device comprises one or more coils wrapped around a core forming at least one winding 3. The winding 3 is a well known accessory to this kind of device and is therefore only briefly mentioned in this context. The device further comprises a core frame 7 and one magnetic core leg 5 arranged between and interconnecting two yokes (not illustrated) in the core frame 7. The magnetic core leg 5, being cooled by a cooling medium such as oil, is comprised of a stack of core segments 11 of a magnetic material. The core leg 5 is arranged in compression in the core frame 7, and the core leg 5 is arranged with core gaps 13 arranged to separate the core segments 11. Further the core leg 5 is also arranged with a plurality of spacers 15, arranged in the core gaps 13 between the core segments 11. The spacers 15, typically made of a ceramic material such as steatite, have a cross-section of hexagonal shape with an upper and a lower end-face being in contact with the core segments 11. The spacers 15 in the core gaps 13 are arranged densely packed so as to form a compact filling in the gap 13. A center hole 9 is arranged vertically through the core frame 7 and the core leg 5 for the purpose of being able to lift and transport the induction device 1. The cooling medium flows through, from the bottom and upwards, the center hole 9 when the induction device 1 is in operation.

An increased stiffness of the core leg 5 is achieved by the arrangement of said spacers 15, thus reducing the vibrations and the emitted noise from said induction device 1.

The edges of the end faces of two neighboring spacers 15 are arranged with chamfers allowing the neighboring spacers 15 to form a common cooling duct for a cooling medium. The width (w) of the chamfer is at least 20% of the radius (r) of the chamfer and the height (h) of the cooling duct is at least 20% of the height of the spacer (y). The cooling medium, typically oil, will flow through the cooling ducts keeping the temperature of the core segments 11 within a satisfactory level. The cooling ducts can be formed by different shapes of the chamfers. Examples of shapes are straight edges, curved concave/convex edges or irregularly shaped edges, which all form cooling ducts. In addition it can be mentioned that at least two of the edges of the end faces of two neighboring spacers 15 must be arranged with chamfers allowing the neighboring spacers 15 to form a common cooling duct for a cooling medium.

Figure 2:
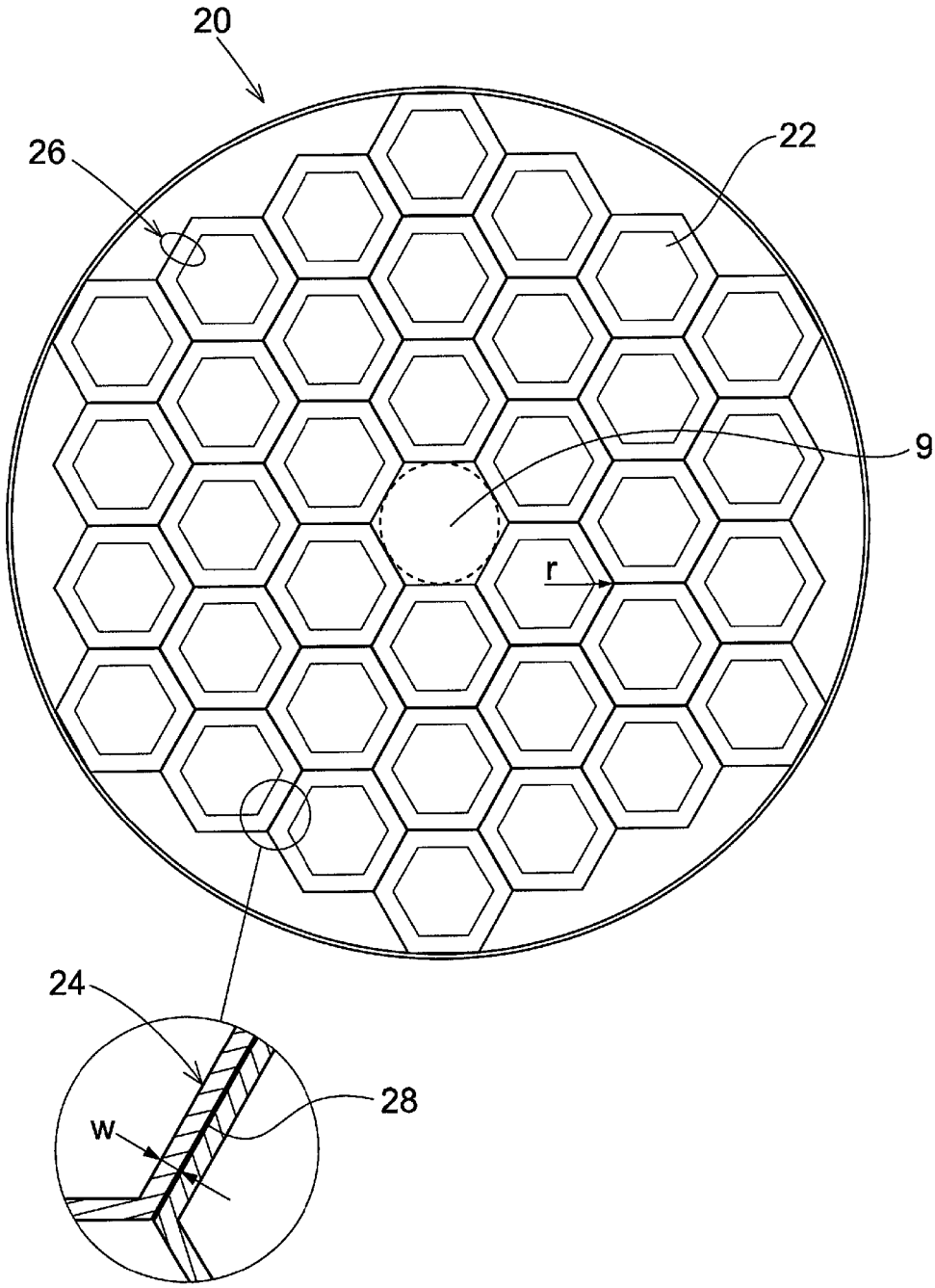
FIG. 2 is a cross sectional view, A-A, through the induction device shown in FIG. 1.

FIG. 2 illustrates a core gap 20, in a cross section A-A through the device shown in FIG. 1, with the spacers 22 arranged so that two neighboring spacers 22 are arranged so that the side faces are each arranged opposite to and preferably in contact with each other so as to form a compact filling in the gap 20. The edges 24 of the end faces of the spacers 22 are arranged with chamfers 26 allowing two neighboring spacers 22 to form a common cooling duct 28 for a cooling medium. The spacers 22 are arranged with an upper end face, a lower end face and six side faces. The spacers 22 are arranged so that the side faces of two neighboring spacers 22 are arranged preferably in contact with, or at a very close distance from, each other.

Figure 3:
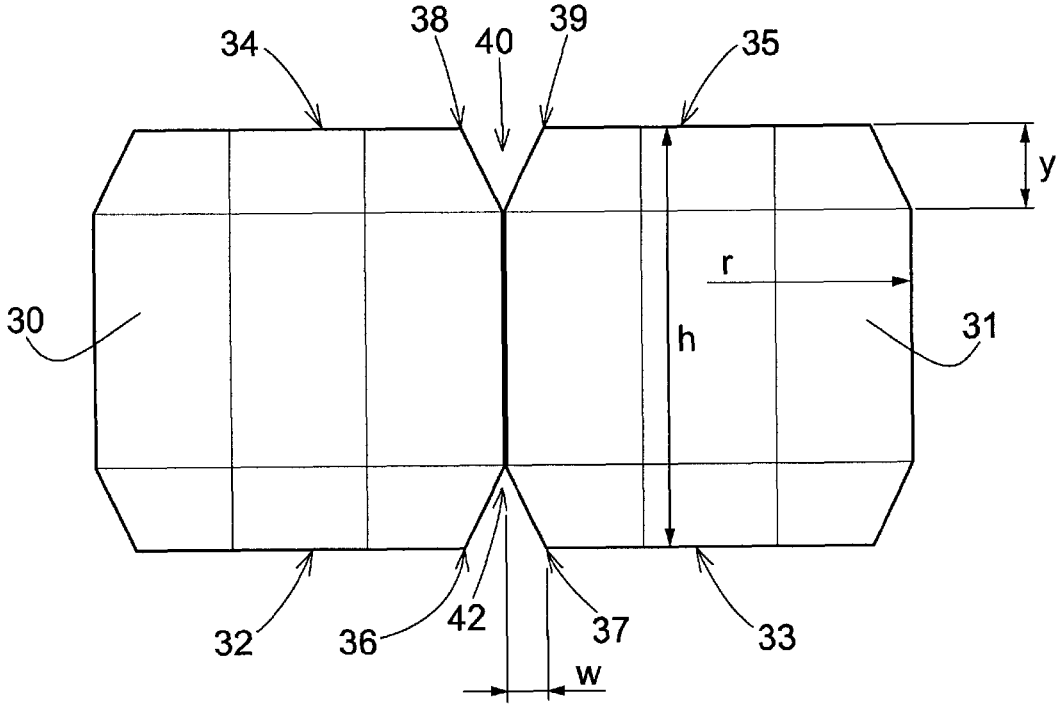
FIGS. 3-6 are side views of two neighboring spacers where the edges of the end faces are arranged with chamfers, with edges of different shape, allowing said neighboring spacers to form a common cooling duct for a cooling medium.

FIG. 3 illustrates two neighboring spacers 30-31, with a cross section of hexagonal shape, densely packed. The edges of the end faces 32-35 of the spacers 30-31 are arranged with chamfers 36-39 allowing two neighboring spacers 30-31 to form common cooling ducts 40, 42 for a cooling medium. The chamfers 36-39 are formed with straight edges.

Figure 4:
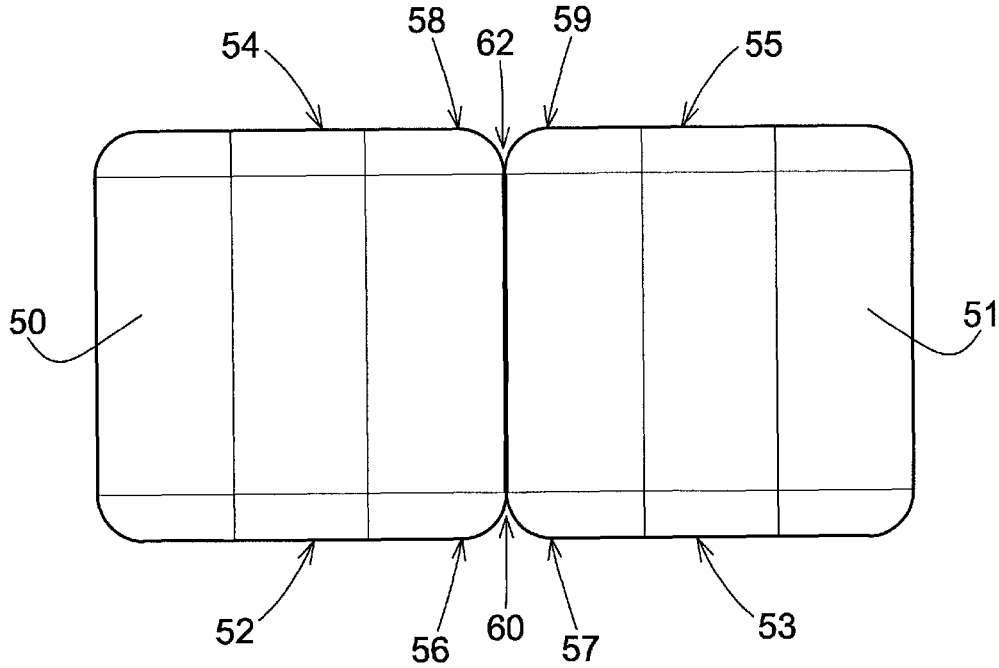

FIG. 4 illustrates two neighboring spacers 50-51, with a cross section of hexagonal shape, densely packed. The edges of the end faces 52-55 of the spacers 50-51 are arranged with chamfers 56-59 allowing two neighboring spacers 50-51 to form common cooling ducts 60, 62 for a cooling medium. The chamfers 56-59 are formed with concave edges.

Figure 5:
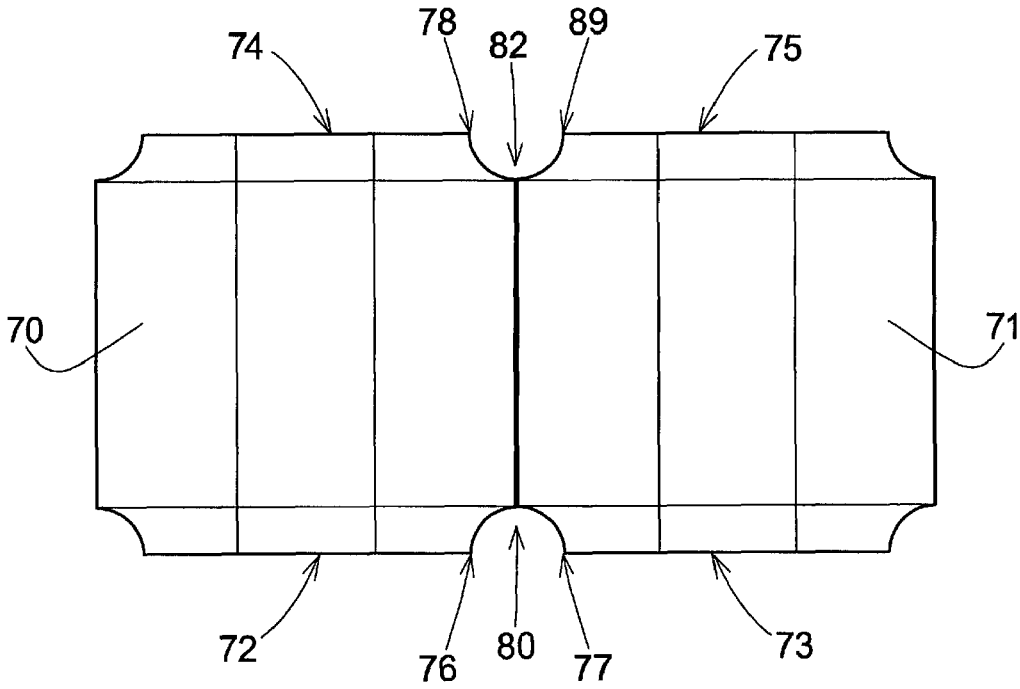

FIG. 5 illustrates two neighboring spacers 70-71, with a cross section of hexagonal shape, densely packed. The edges of the end faces 72-75 of the spacers 70-71 are arranged with chamfers 76-79 allowing two neighboring spacers 70-71 to form common cooling ducts 80, 82 for a cooling medium. The chamfers 76-79 are formed with convex edges.

Figure 6:
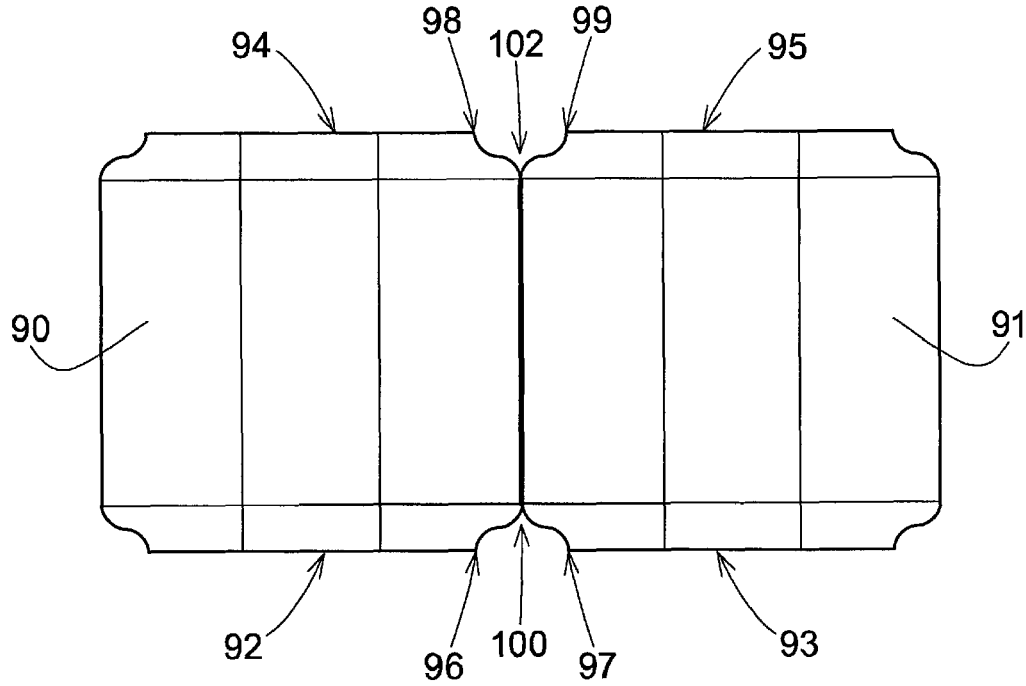

FIG. 6 illustrates two neighboring spacers 90-91, with a cross section of hexagonal shape, densely packed. The edges of the end faces 92-95 of the spacers 90-91 are arranged with chamfers 96-99 allowing two neighboring spacers 90-91 to form common cooling ducts 100,102 for a cooling medium. The chamfers 96-99 are formed with irregular edges.

Although favorable the scope of the invention must not be limited by the embodiments presented but contain also embodiments obvious to a person skilled in the art.

What is claimed is:

1. An induction device for association with high voltage electric transmission systems comprising:

at least one core frame, at least one winding arranged around said core frame, at least one magnetic core leg arranged in said core frame, a stack of core segments of a magnetic material being cooled by a cooling medium, arranged in compression in said core frame, core gaps being arranged to separate said core segments, and a plurality of spacers, arranged in said core gaps between the core segments, the plurality of spacers having a cross section of hexagonal shape and having an upper and a lower end-face being in contact with the core segments, characterized in that said spacers are arranged densely packed so as to form a compact filling in at least one of the core gaps, and that for at least some of the spacers the edges of the end faces of two neighboring spacers are arranged with chamfers allowing said neighboring spacers to form a common cooling duct for said cooling medium.

2. The induction device of claim 1, characterized in that the width (w) of said chamfers is at least 20% of the radius (r) of one of said spacers.

3. The induction device of claim 1, characterized in that the height (h) of said cooling duct is at least 20% of the height (y) of one of said spacers.

4. The induction device of claim 1, characterized in that said induction device is a shunt reactor.

* * * * *